US008138434B2

(12) United States Patent
Tang et al.

(10) Patent No.: US 8,138,434 B2
(45) Date of Patent: Mar. 20, 2012

(54) WATERPROOF PRESS KEY AND ASSEMBLY OF AN ELECTRONIC DEVICE HOUSING AND THE WATERPROOF PRESS KEY

(75) Inventors: Wen-Lang Tang, Taipei Hsien (TW); Wen-Hsin Wang, Taipei Hsien (TW)

(73) Assignee: Wistron Corporation, Taipei (TW)

( * ) Notice: Subject to any disclaimer, the term of this patent is extended or adjusted under 35 U.S.C. 154(b) by 310 days.

(21) Appl. No.: 12/456,413

(22) Filed: Jun. 16, 2009

(65) Prior Publication Data

US 2010/0044198 A1 Feb. 25, 2010

(30) Foreign Application Priority Data

Aug. 22, 2008 (TW) ..... 97215190 U

(51) Int. Cl.
*H01H 13/06* (2006.01)

(52) U.S. Cl. ..... 200/302.2

(58) Field of Classification Search ..... 299/344, 299/302.2, 302.1, 341, 329; 200/344, 302.2, 200/302.1, 341, 329
See application file for complete search history.

(56) References Cited

U.S. PATENT DOCUMENTS

| | | | | | |
|---|---|---|---|---|---|
| 3,083,278 | A * | 3/1963 | Mukai | 200/302.2 |
| 4,417,113 | A * | 11/1983 | Saito et al. | 200/302.2 |
| 4,508,942 | A * | 4/1985 | Inaba | 200/5 A |
| 4,677,268 | A * | 6/1987 | Nemeth et al. | 200/513 |
| 5,115,106 | A * | 5/1992 | Weiland et al. | 200/517 |
| 5,118,909 | A * | 6/1992 | Husting | 200/81 H |
| 5,258,592 | A * | 11/1993 | Nishikawa et al. | 200/302.2 |
| 5,743,384 | A * | 4/1998 | Clark | 200/341 |
| 6,093,899 | A * | 7/2000 | Takano et al. | 200/302.1 |
| 6,239,391 | B1 * | 5/2001 | Nishijima et al. | 200/302.2 |
| 6,483,057 | B1 * | 11/2002 | Wu | 200/302.2 |
| 6,608,270 | B2 * | 8/2003 | Donofrio et al. | 200/302.1 |
| 6,794,592 | B1 * | 9/2004 | Liu et al. | 200/302.3 |
| 6,963,039 | B1 * | 11/2005 | Weng et al. | 200/302.1 |
| 2009/0236207 | A1 * | 9/2009 | Shi et al. | 200/302.2 |

* cited by examiner

*Primary Examiner* — Briggitte R Hammond
(74) *Attorney, Agent, or Firm* — John A. Fortkort; Fortkort & Houston P.C.

(57) ABSTRACT

A waterproof press key includes a key body, a rigid support component, and a waterproofing ring. The key body is made of a resilient material, and includes a top wall and a surrounding wall extending downwardly from the top wall. The rigid support component includes a supporting portion that is disposed at the surrounding wall. The waterproofing ring projects from the outer wall surface of the surrounding wall. The supporting portion overlaps with at least a part of a height section of the surrounding wall from which the waterproofing ring projects to thereby enhance the waterproofing effect of the waterproof press key.

18 Claims, 3 Drawing Sheets

WATERPROOF PRESS KEY AND ASSEMBLY OF AN ELECTRONIC DEVICE HOUSING AND THE WATERPROOF PRESS KEY

CROSS-REFERENCE TO RELATED APPLICATION

This application claims priority of Taiwanese Application No. 097215190, filed on Aug. 22, 2008.

BACKGROUND OF THE INVENTION

1. Field of the Invention

The present invention relates to a waterproof press key, particularly a waterproof press key having a key body made of a resilient material.

2. Description of the Related Art

Referring to FIG. 1, a conventional waterproof press key includes a key body 11 disposed at a housing 10 of an electronic device and corresponding to a switch 12. The key body 11 and the housing 10 are formed by double injection molding so that the key body 11 is connected tightly to the housing 10 to achieve a waterproof effect. Although double injection molding ensures that the key body 11 is connected tightly to the housing 10 to achieve the effect of waterproofing, there is a disadvantage in that the cost of the mold for double injection molding of the key body 11 and the housing 10 is relatively high.

Referring to FIG. 2, another conventional waterproof press key includes a key body 13 disposed at a housing 14 of an electronic device, and a rubber film 16 disposed between the key body 13 and a switch 15. The rubber film 16 is positioned at an inner wall 17 between the housing 14 and the switch 15 for waterproofing. Although the effect of waterproofing can be achieved through the provision of the rubber film 16, the presence of the rubber film 16 and the inner wall 17 not only increases the assembly time and cost, but also increases the occupied space. Therefore, this kind of waterproof press key also has some disadvantages.

SUMMARY OF THE INVENTION

Therefore, an object of the present invention is to provide a waterproof press key that has a simple structure, that is relatively inexpensive, and that does not increase the assembly time and occupied space.

Accordingly, the waterproof press key of the present invention comprises a keybody, a rigid support component, and a waterproofing ring. The key body is made of a resilient material, and includes a top wall and a surrounding wall extending downwardly from the top wall. The rigid support component includes a supporting portion that is disposed at the surrounding wall. The waterproofing ring projects from the outer wall surface of the surrounding wall. The supporting portion overlaps with at least a part of a height section of the surrounding wall from which the waterproofing ring projects.

Preferably, the supporting portion overlaps with at least one-half of the height section of the surrounding wall from which the waterproofing ring projects.

Preferably, the key body further includes a first skirt portion extending outwardly from a bottom edge of the surrounding wall, and the supporting portion is in a shape of a loop and is connected to an inner wall surface of the surrounding wall. The rigid support component further includes a second skirt portion extending outwardly from a bottom edge of the supporting portion for connecting to the first skirt portion.

Preferably, the rigid support component may be made of stainless steel, other metals, or rigid nonmetal materials.

Preferably, the key body further includes at least one flange projecting from a bottom face of the first skirt portion.

An assembly of a waterproof press key and an electronic device housing according to the present invention comprises an electronic device housing and a waterproof press key. The electronic device housing includes a housing wall formed with a hole that is defined by a hole-defining wall. The housing wall has an inner face and an outer face. The waterproof press key is disposed on the electronic device housing and includes a key body, a rigid support component, and a waterproofing ring. The key body includes a cap portion made of a resilient material and a first skirt portion. The cap portion includes a top wall and a surrounding wall that extends downwardly from the top wall. The first skirt portion extends outwardly from a bottom edge of the surrounding wall. The top wall of the cap portion is exposed from the outer face of the housing wall via the hole, and the first skirt portion abuts against the inner face of the housing wall when the key body is disposed on the electronic device housing. The rigid support component includes a supporting portion that is disposed at the surrounding wall. The waterproofing ring projects from an outer wall surface of the surrounding wall and abuts against the hole-defining wall. The supporting portion overlaps with at least a part of a height section of the surrounding wall from which the waterproofing ring projects.

In the present invention, the rigid support component is used to strengthen the waterproofing effect of the waterproof press key. Due to the relatively simple structure of the waterproof press key, manufacturing costs are lower. In addition, since the rigid support component is directly joined to the inside of the key body, the required assembly time and the required occupied space are significantly reduced.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
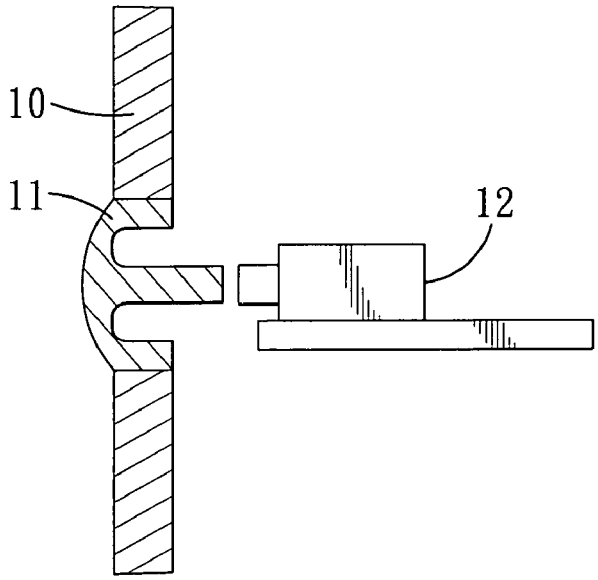
FIG. 1 PRIOR ART
FIG. 1 is a sectional view of a conventional waterproof press key.
Figure 2:
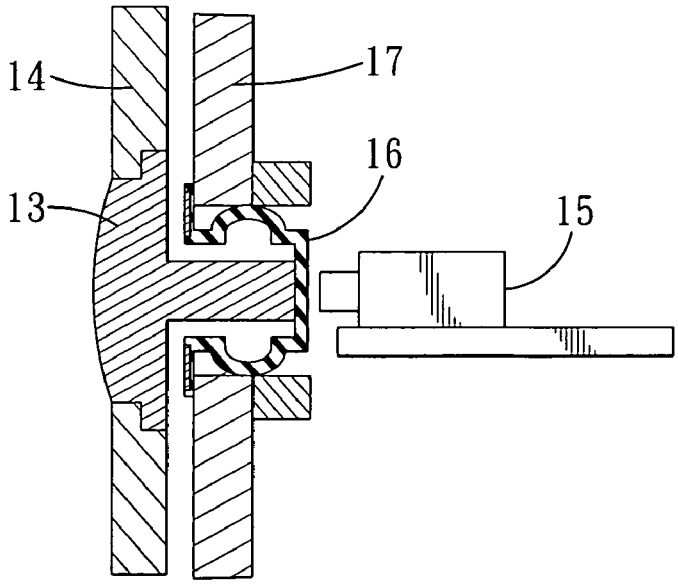
FIG. 2 PRIOR ART
FIG. 2 is a sectional view of another conventional waterproof press key.
Figure 3:
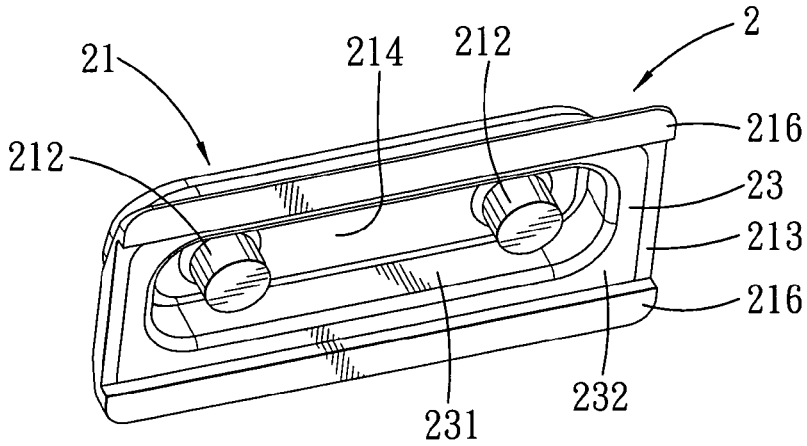
FIG. 3 is a perspective view of a preferred embodiment of a waterproof key according to the present invention.
Figure 4:
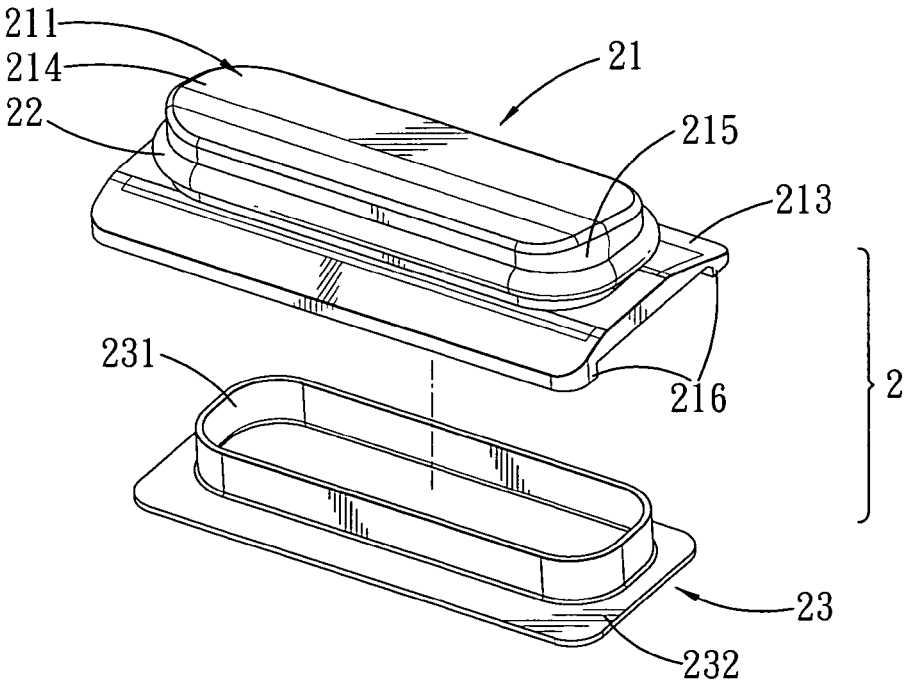
FIG. 4 is an exploded perspective view of the preferred embodiment.
Figure 5:
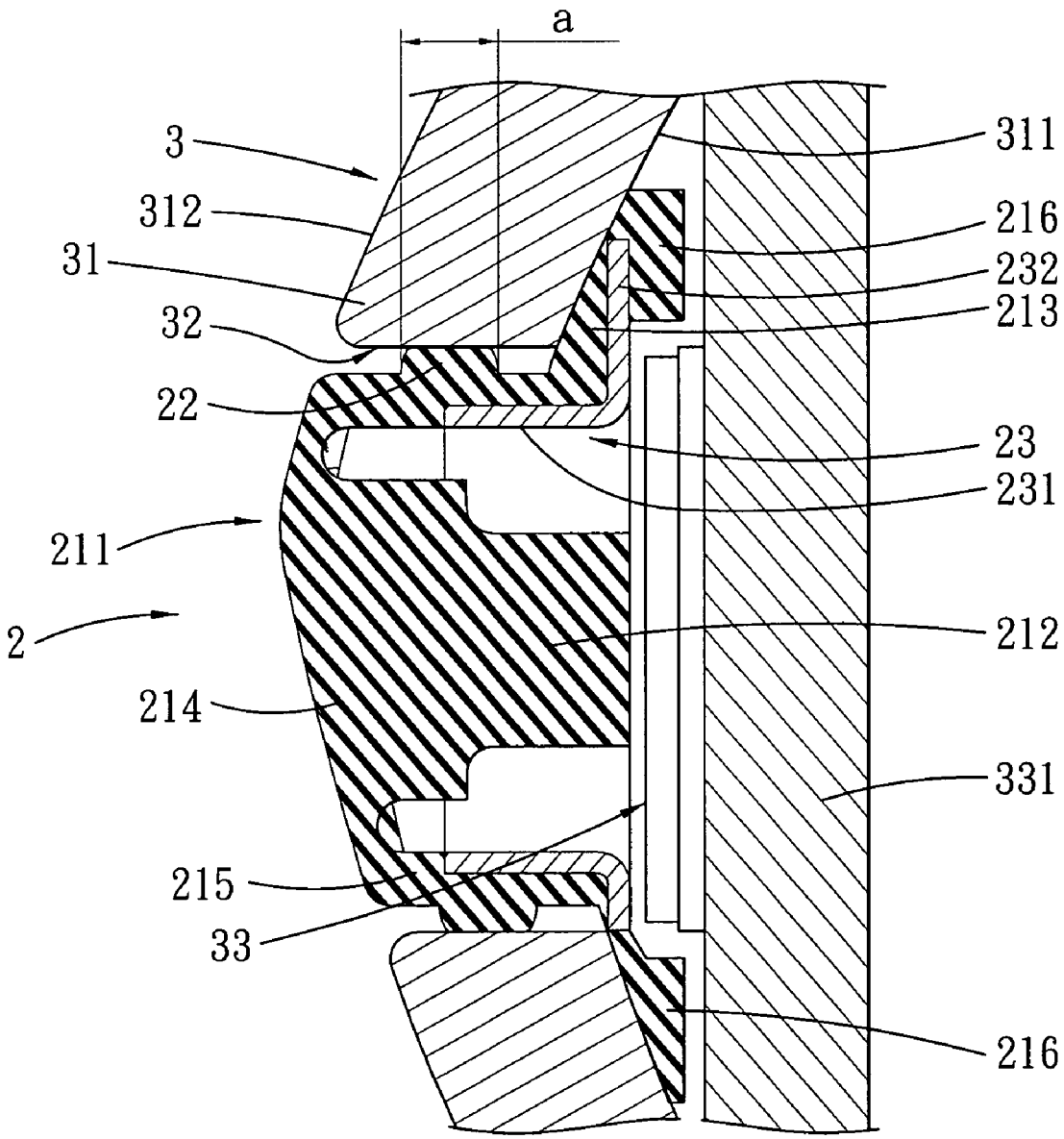
FIG. 5 is a sectional view of the preferred embodiment when disposed at an electronic device housing.

Referring to FIGS. 3 to 5, the preferred embodiment of a waterproof press key 2 according to this invention includes a key body 21, a waterproofing ring 22, and a rigid support component 23 connected to the key body 21. The key body 21 is made of a resilient material such as rubber or silicone, and includes a cap portion 211, at least one actuator portion 212, and a first skirt portion 213. The cap portion 211 includes a top wall 214 and a surrounding wall 215 extending downwardly from the top wall 214 and in a shape of a loop. The first skirt portion 213 extends outwardly and laterally from a bottom edge of the surrounding wall 215. In this embodiment, an outline of the first skirt portion 213 is generally rectangular. A flange 216 projects from a bottom face of each of two long side edges of the first skirt portion 213. Certainly, the shape and number of the flange 216 are not limited to those of the preferred embodiment, and may vary with the outer form of the key body 21. The actuator portion 212 extends downwardly from a bottom face of the top wall 214 and is surrounded by the surrounding wall 215. The waterproofing ring 22 projects from an outer wall surface of the surrounding wall 215 and is in a form of a loop. In this embodiment, the waterproofing ring 22 is connected integrally to the key body 21.

The rigid support component 23 includes a supporting portion 231 and a second skirt portion 232 extending outwardly from a bottom edge of the supporting portion 231. The supporting portion 231 is disposed at the surrounding wall 215. While the rigid support component 23 is formed by punching a stainless steel piece in this embodiment, other metals or rigid nonmetal materials may be selected as the material of the rigid support component 23. The supporting portion 231 is in a shape of a loop. When the rigid support component 23 is connected to the key body 21, the supporting portion 231 is disposed at an inner wall surface of the surrounding wall 215, and the second skirt portion 232 is connected to a bottom face of the first skirt portion 213 of the key body 21. It is noted that, when the rigid support component 23 is connected to the key body 21, the supporting portion 231 overlaps with at least a part of a height section (a) of the surrounding wall 215 from which the waterproofing ring 22 projects. In the preferred embodiment, the supporting portion 231 overlaps with at least one-half of the height section (a) of the surrounding wall 215 from which the waterproofing ring 22 projects. Preferably, some parts of the supporting portion 231 completely overlap the height section (a).

In this embodiment, the rigid support component 23 and the key body 21 are interconnected by hot pressing after the key body 21 and the rigid support component 23 are separately formed. Alternatively, the rigid support component 23 is formed first, followed by subjecting the rigid support component 23 to insert molding so as to form the key body 21.

The waterproof press key 2 may be disposed at, for example, an electronic device housing 3. The electronic device housing 3 includes a housing wall 31 formed with a hole 32 that is defined by a hole-defining wall. The housing wall 31 has an inner face 311 and an exposed outer face 312. When the waterproof press key 2 is disposed at the electronic device housing 3, the first skirt portion 213 of the key body 21 is attached to the inner face 311 of the housing wall 31, the cap portion 211 extends into the hole 32, and the top wall 214 of the cap portion 211 is exposed from the outer face 312 of the housing wall 31 via the hole 32 for pressing. The waterproofing ring 22 abuts against the hole-defining wall of the hole 32.

When the top wall 214 of the cap portion 211 is pressed, the portion of the top wall 214 provided with the actuator portion 212 deforms, causing the actuator portion 212 to move inwardly so as to actuate a circuit unit 33 in the electronic device housing 3. The circuit unit 33 herein is a switch disposed on a circuit board 331.

It is noted that, since the key body 21 is made of a resilient material, the supporting portion 231 is provided to enhance rigidity of the surrounding wall 215. In addition, because the supporting portion 231 overlaps with at least a part of the height section (a) of the surrounding wall 215 from which the waterproofing ring 22 projects, deformation of the surrounding wall 215 toward the actuator portion 212 which can affect tightness between the waterproofing ring 22 and the hole-defining wall of the hole 32 does not easily occur when the waterproofing ring 22 abuts against the hole-defining wall of the hole 32. In other words, the supporting portion 231 can support the waterproofing ring 22 so that the waterproofing ring 22 abuts against the hole-defining wall of the hole 32 more tightly for maintaining the waterproofing effect. The greater the extent of overlap between the supporting portion 231 and the height section (a) of the surrounding wall 215, the better will be the supporting effect for the waterproofing ring 22. Moreover, through friction between the waterproofing ring 22 and the hole-defining wall of the hole 32, undesired movement of the waterproof press key 2 relative to the hole 32 that can result in separation of the waterproof press key 2 from the electronic device housing 3 can be avoided.

Another effect of the supporting portion 231 is that the cap portion 211 will not collapse in view of the supporting portion 231 when the cap portion 211 is pressed. In addition, the outline of a top edge of the supporting portion 231 can be felt by a finger when the cap portion 211 is pressed such that a more noticeable feeling of pressing is possible.

Furthermore, in this embodiment, because the second skirt portion 232 of the rigid support component 23 is connected to the first skirt portion 213 of the key body 21, when the key body 21 is disposed at the electronic device housing 3, the second skirt portion 232 can also increase the rigidity of the first skirt portion 213 and make the first skirt portion 213 abut against the inner face 311 of the housing wall 31 so as to prevent the key body 21 from being pulled out from the housing wall 31 in the direction of the outer face 312.

In addition, because the key body 21 corresponds to the circuit unit 33 in the electronic device housing 3 when the key body is disposed at the hole 32 of the housing wall 31, and because of the presence of the flanges 216, the distance between the key body 21 and the circuit board 331 can be shortened. As such, when the waterproof press key 2 is pressed, the drawback that the entire waterproof press key 2 displaces inwardly into the electronic device housing 3 due to an excessively long distance between the key body 21 and the circuit board 331 can be avoided.

In another exemplary embodiment, the second skirt portion 232 of the rigid support component 23 can be omitted if the rigidity of the first skirt portion 213 of the key body 21 is sufficient.

It has been verified through experiments that the waterproof effect of the electronic device housing 3 provided with the waterproof press key 2 of this embodiment can meet the IPX7 standard in the IEC 60529.

In sum, the waterproof effect of the waterproof press key 2 is enhanced by providing the rigid support component 23. Because of the simple structure of the rigid support component 23, manufacturing costs are lower. By connecting directly the rigid support component 23 to the inside of the key body 21, the required assembly time and the required occupied space are significantly lower.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A waterproof press key comprising:

a key body made of a resilient material, said key body including a top wall and a surrounding wall that extends downwardly from said top wall and that has an outer wall surface;

a rigid support component including a supporting portion that is disposed at said surrounding wall; and a waterproofing ring projecting from said outer wall surface of said surrounding wall, wherein said supporting portion overlaps with at least a part of a height section of said surrounding wall from which said waterproofing ring projects;

wherein said supporting portion is configured to support said surrounding wall of said key body so as to enhance the rigidity of said surrounding wall.

2. The waterproof press key as claimed in claim 1, wherein said supporting portion overlaps with at least one-half of the height section of said supporting wall from which said waterproofing ring projects.

3. The waterproof press key as claimed in claim 2, wherein said surrounding wall has a bottom edge, and said key body further includes a first skirt portion extending outwardly from said bottom edge of said surrounding wall, said supporting portion being in a shape of a loop.

4. The waterproof press key as claimed in claim 3, wherein said supporting portion has a bottom edge, and said support component further includes a second skirt portion extending outwardly from said bottom edge of said supporting portion and connected to said first skirt portion.

5. The waterproof press key as claimed in claim 3, wherein said surrounding wall further has an inner wall surface, and said supporting portion is connected to said inner wall surface of said surrounding wall.

6. The waterproof press key as claimed in claim 5, wherein said rigid support component is made of metal.

7. The waterproof press key as claimed in claim 6, wherein said waterproofing ring is connected integrally to said key body.

8. The waterproof press key as claimed in claim 7, wherein said first skirt portion has a bottom face, and said key body further includes at least one flange projecting from said bottom face of said first skirt portion.

9. The waterproof press key as claimed in claim 7, wherein said key body further includes at least one actuator portion extending downwardly from said top wall and surrounded by said surrounding wall.

10. An assembly of a waterproof press key and an electronic device housing, comprising:

an electronic device housing including a housing wall formed with a hole that is defined by a hole-defining wall, said housing wall having an inner face and an outer face; and a waterproof press key disposed on said electronic device housing and including a key body including a cap portion made of a resilient material and a first skirt portion, said cap portion including a top wall and a surrounding wall that extends downwardly from said top wall and that has a bottom edge and an outer wall surface, said first skirt portion extending outwardly from said bottom edge of said surrounding wall, said top wall of said cap portion being exposed from said outer face of said housing wall via said hole and said first skirt portion abutting against said inner face of said housing wall when said key body is disposed on said electronic device housing, a rigid support component including a supporting portion that is disposed at said surrounding wall, and a waterproofing ring projecting from said outer wall surface of said surrounding wall and abutting against said hole-defining wall, wherein said supporting portion overlaps with at least a part of a height section of said surrounding wall from which said waterproofing ring projects.

11. The assembly of a waterproof press key and an electronic device housing as claimed in claim 10, wherein said supporting portion overlaps with at least one-half of the height section of said surrounding wall from which said waterproofing ring projects.

12. The assembly of a waterproof press key and an electronic device housing as claimed in claim 11, wherein said supporting portion is in a shape of a loop.

13. The assembly of a waterproof press key and an electronic device housing as claimed in claim 12, wherein said supporting portion has a bottom edge, and said rigid support component further includes a second skirt portion extending outwardly from said bottom edge of said supporting portion and connected to said first skirt portion.

14. The assembly of a waterproof press key and an electronic device housing as claimed in claim 13, wherein said surrounding wall further has an inner wall surface, and said supporting portion is connected to said inner wall surface of said surrounding wall.

15. The assembly of a waterproof press key and an electronic device housing as claimed in claim 14, wherein said rigid support component is made of metal.

16. The assembly of a waterproof press key and an electronic device housing as claimed in claim 15, wherein said waterproofing ring is connected integrally to said key body.

17. The assembly of a waterproof press key and an electronic device housing as claimed in claim 16, wherein said first skirt portion has a bottom face, and said key body further includes at least one flange projecting from said bottom face of said first skirt portion.

18. The assembly of a waterproof press key and an electronic device housing as claimed in claim 16, wherein said key body further includes at least one actuator portion extending downwardly from said top wall and surrounded by said surrounding wall.

* * * * *